US008303368B2

(12) United States Patent
Li et al.

(10) Patent No.: US 8,303,368 B2
(45) Date of Patent: Nov. 6, 2012

(54) SIMULATED EYE FOR TOY

(75) Inventors: Xiong Li, Shenzhen (CN); Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 231 days.

(21) Appl. No.: 12/647,402

(22) Filed: Dec. 25, 2009

(65) Prior Publication Data

US 2011/0097968 A1 Apr. 28, 2011

(30) Foreign Application Priority Data

Oct. 22, 2009 (CN) ..... 2009 1 0308644

(51) Int. Cl.
*A63H 3/40* (2006.01)

(52) U.S. Cl. ..... 446/343

(58) Field of Classification Search ..... 446/343
See application file for complete search history.

(56) References Cited

U.S. PATENT DOCUMENTS 1,908,098 A * 5/1933 Zaiden ..... 446/342
4,342,174 A * 8/1982 Nikaido ..... 446/158

FOREIGN PATENT DOCUMENTS

TW 545278 U 8/2003

* cited by examiner

*Primary Examiner* — Michael Dennis
(74) *Attorney, Agent, or Firm* — Altis Law Group, Inc.

(57) ABSTRACT

A simulated eye is capable of being changeable between an opened state and a closed state. The simulated eye includes an eyeball, an upper eyelid covering the eyeball, a pivot rod, at least one transmission member, and a driving device. The pivot rod is pivotally coupled to the eyeball, the upper eyelid is fixed to the pivot rod, the at least one transmission member connects the pivot rod with the driving device in a manner that the at least one transmission member drives the pivot rod to rotate when the driving device pulls the at least one transmission member.

10 Claims, 5 Drawing Sheets

SIMULATED EYE FOR TOY

BACKGROUND

1. Technical Field

The disclosure relates to toys and, more particularly, to a simulated eye for a toy.

2. Description of Related Art

A typical replica of eyes always imitates human's eyes by replicating limited characters of the eyes. Accordingly, other simulations are needed to make the imitated eyes more lifelike. Therefore, what is needed is a simulated eye capable of behaving in a more lifelike manner.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
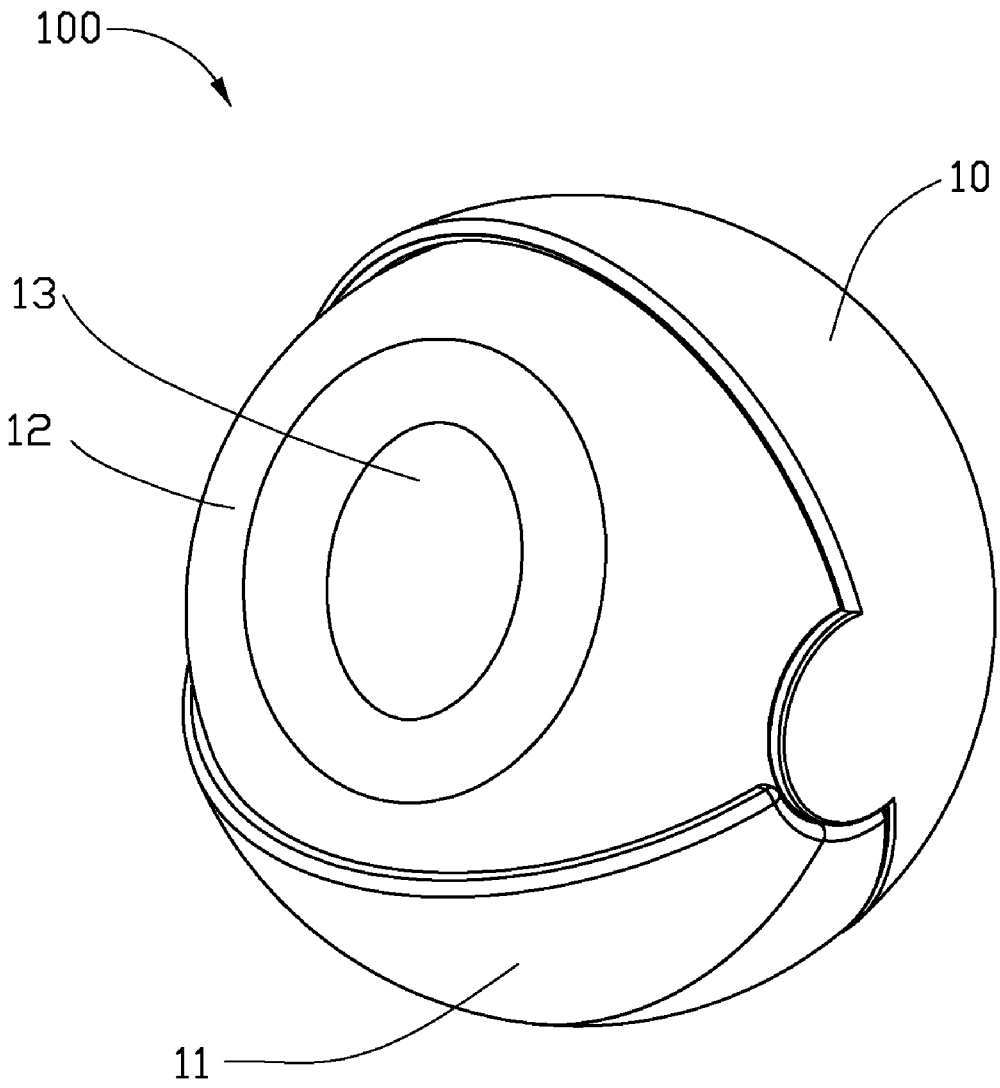
FIG. 1 is a perspective view of a simulated eye in an opened state in accordance with one embodiment.
Figure 2:
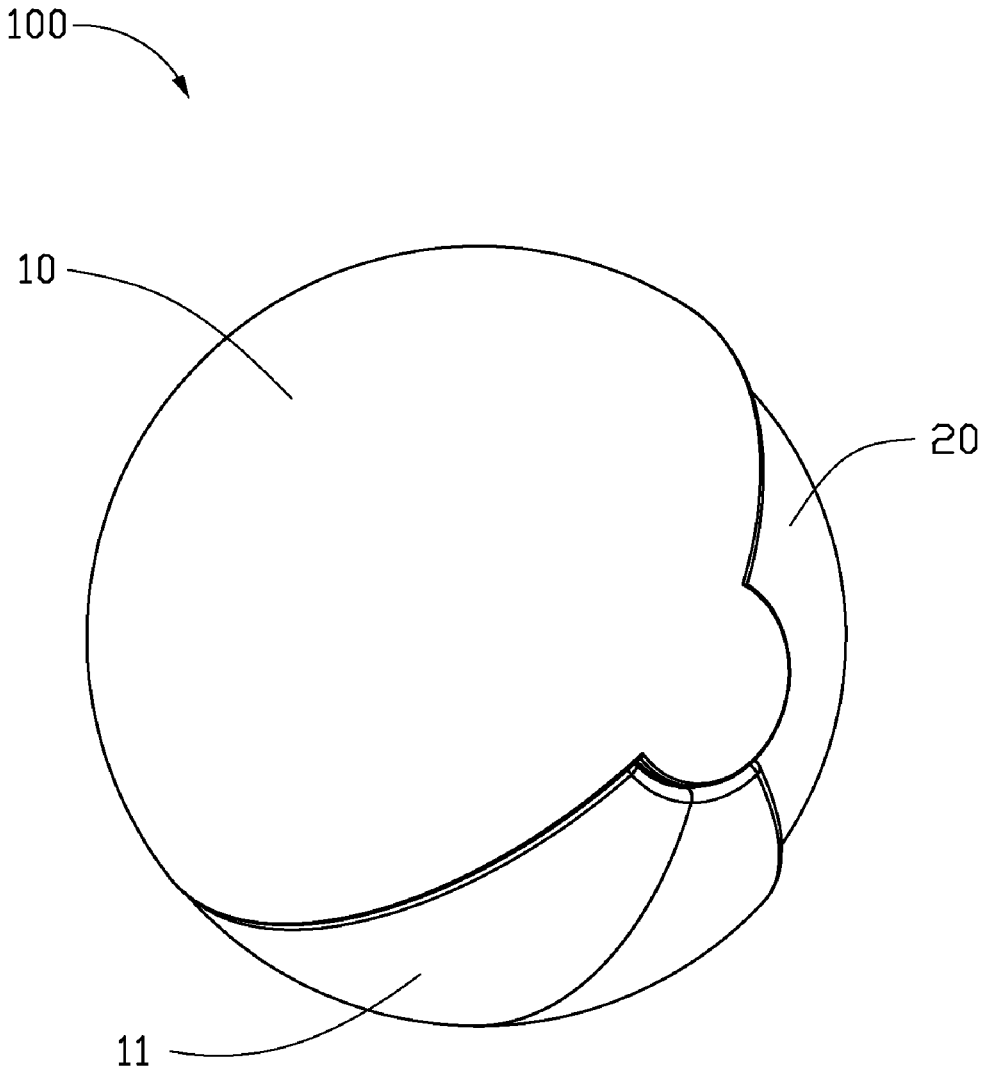
FIG. 2 is also a perspective view of the simulated eye of FIG. 1, but showing the simulated eye being in a closed state.
Figure 3:
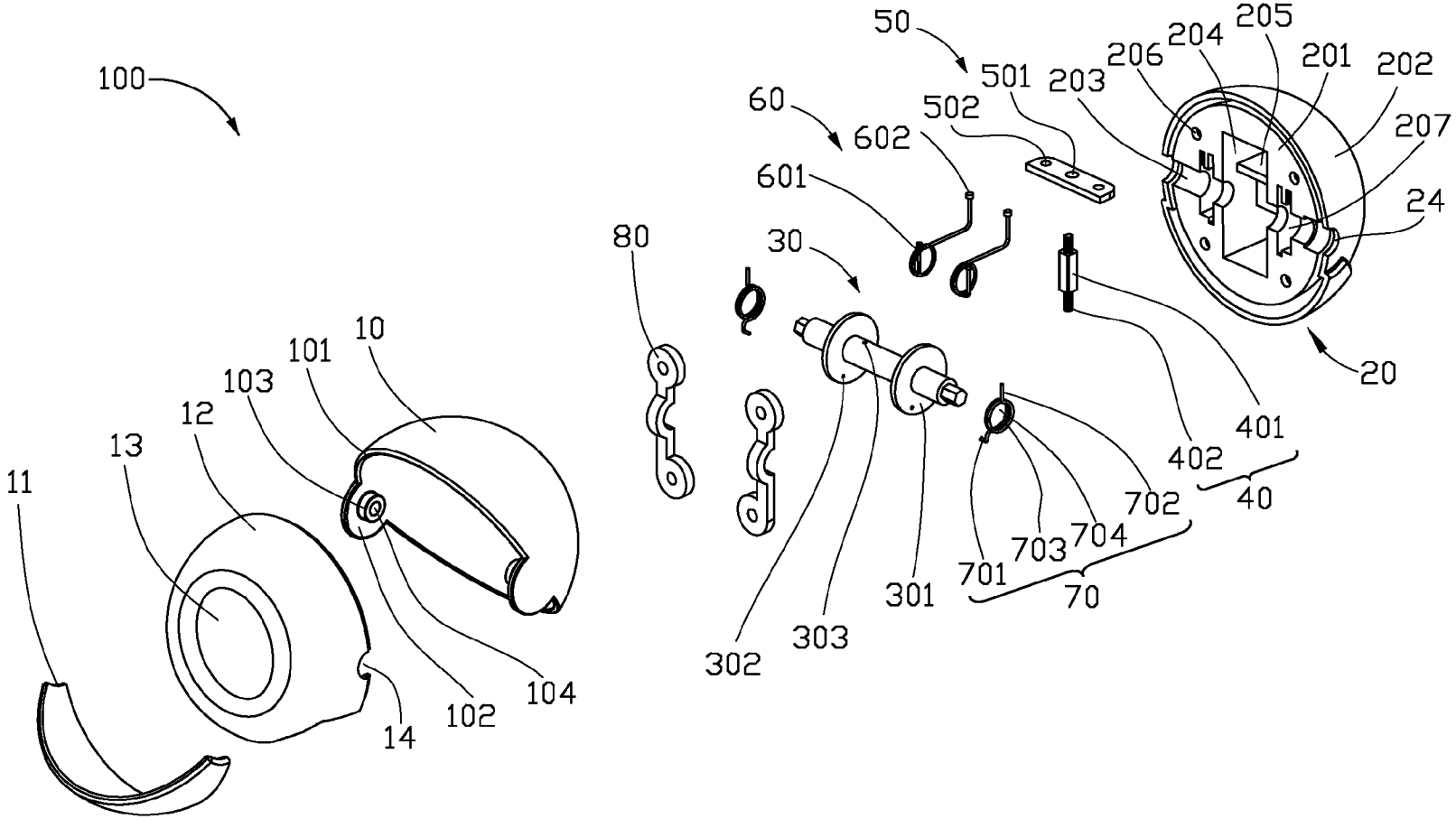
FIG. 3 is an exploded view of the simulated eye of FIG. 1.

Referring to FIGS. 1-3, a simulated eye 100 is changeable between an opened state and a closed state. The simulated eye 100 includes a semispherical upper eyelid 10, a lower eyelid 11, a semispherical eyeball 12, and a semispherical shell 20. The eyeball 12 engages with the shell 20 to form a sphere. The upper eyelid 10 covers the eyeball 12 and the shell 20. The lower eyelid 11 is attached to the eyeball 12. An iris 13 is disposed on an external surface of the eyeball 100. The simulated eye 10 is fixed to a toy or a robot via the shell 20.

The simulated eye 100 further includes a pivot rod 30, a driving device 40, and two transmission members 60. The two transmission members 60 connect the pivot rod 30 with the driving device 40. The pivot rod 30 is fixed to the upper eyelid 10. The pivot rod 30 is further rotatably coupled to the shell 20. The driving device 40 is fixed to the shell 20. The driving device 40 is configured for pulling the two transmission members 60 to rotate the pivot rod 30, such that the upper eyelid 10 rotates and covers and/or exposes the iris 13.

Two stopping members 301 are symmetrically mounted to the pivot rod 30. The stopping members 301 are perpendicular to the pivot rod 30. Each stopping member 301 defines a first through hole 302. The two first through holes 302 are aligned in a line parallel to the axis of the pivot rod 30. The pivot rod 30 defines two second through holes 303. The second through hole 303 are symmetrically arranged at a part of the pivot rod 30 sandwiched between the two stopping member 301.

The driving device 40 includes a main body 401, and a motor shaft 402. The main body 401 operatively drives the motor shaft 402 to move linearly. A connecting sheet 50 is fixed to an end of the motor shaft 402. The connecting sheet 50 defines a fourth through hole 501, and two fifth through hole 502. The two fifth through hole 502 are symmetrically arranged at two ends of the connecting sheet 50. The fourth through hole 501 is arranged between the two fifth through holes 502. The fourth through hole 501 is configured to receive the motor shaft 402. Each fifth through hole 502 is configured to confine an end 602 of one of the transmission members 60. In the embodiment, the driving device 40 is a step motor or a servo motor.

The transmission members 60 is made of soft material. The transmission members 60 connect the connecting sheet 50 with the pivot rod 30 in a manner such that two ends 601, 602 of each transmission member 60 are fastened to one of the second through holes 303 and one of the fifth through holes 502 correspondingly, and a part of the transmission members 60 wraps around the pivot rod 30. Thus, when the driving member 40 moves the connecting sheet 50 linearly and pulls the transmission members 60, the transmission members 60 convert the linear force of the driving device 40 with respect to the connecting sheet 50 to a rotational force to rotate the pivot rod 30.

Two bearings 102 are symmetrically disposed at opposite sides of the rim of the upper eyelid 10. Two protruding posts 103 protrude inwardly from the bearings 102 correspondingly. Each protruding post 103 defines a round hole 104. The round holes 104 are configured to receive the pivot rod 30, such that the pivot rod 30 is fixed to the upper eyelid 10.

The eyeball 12 defines two non-circular first recesses 14 on opposite sides of the eyeball 12. The two first recesses 14 are formed at the rim of the eyeball 12 symmetrical to each other. The shell 20 is substantially semispherical and is solid. The shell 20 includes a round inner surface 201, and a semispherical external surface 202. The round inner surface 201 defines an elongated recess 203. The elongated recess 203 extends through the external surface 202 to form two second semicircular recesses 24. The two second semicircular recesses 24 correspond to the two first semicircular recesses 24. It should be noted that in assembly, the eyeball 12 engages with the shell 20, and the two second semicircular recesses 24 engage with the two first semicircular recesses 24 to cooperatively form a receiving hole (not shown) for receiving the two protruding post 103. As a result, the upper eyelid 10 is rotatable relative to the eyeball 12 and the shell 20.

The inner surface 201 further defines a receiving space 204, and two limiting slots 207. The elongated recess 203 extends through the receiving space 204 and the two limiting slots 207. The receiving space 204 is formed in the middle of the elongated recess 203. The two limiting slots 207 are symmetrically disposed at two ends of the elongated recess 203. The two limiting slots 207 correspond to the stopping members 301, such that the two stopping members 301 are rotatably received in the two limiting slots 207. The receiving space 204 is arranged between the two limiting slots 207. The receiving space 204 is configured for receiving the driving device 40.

Figure 4:
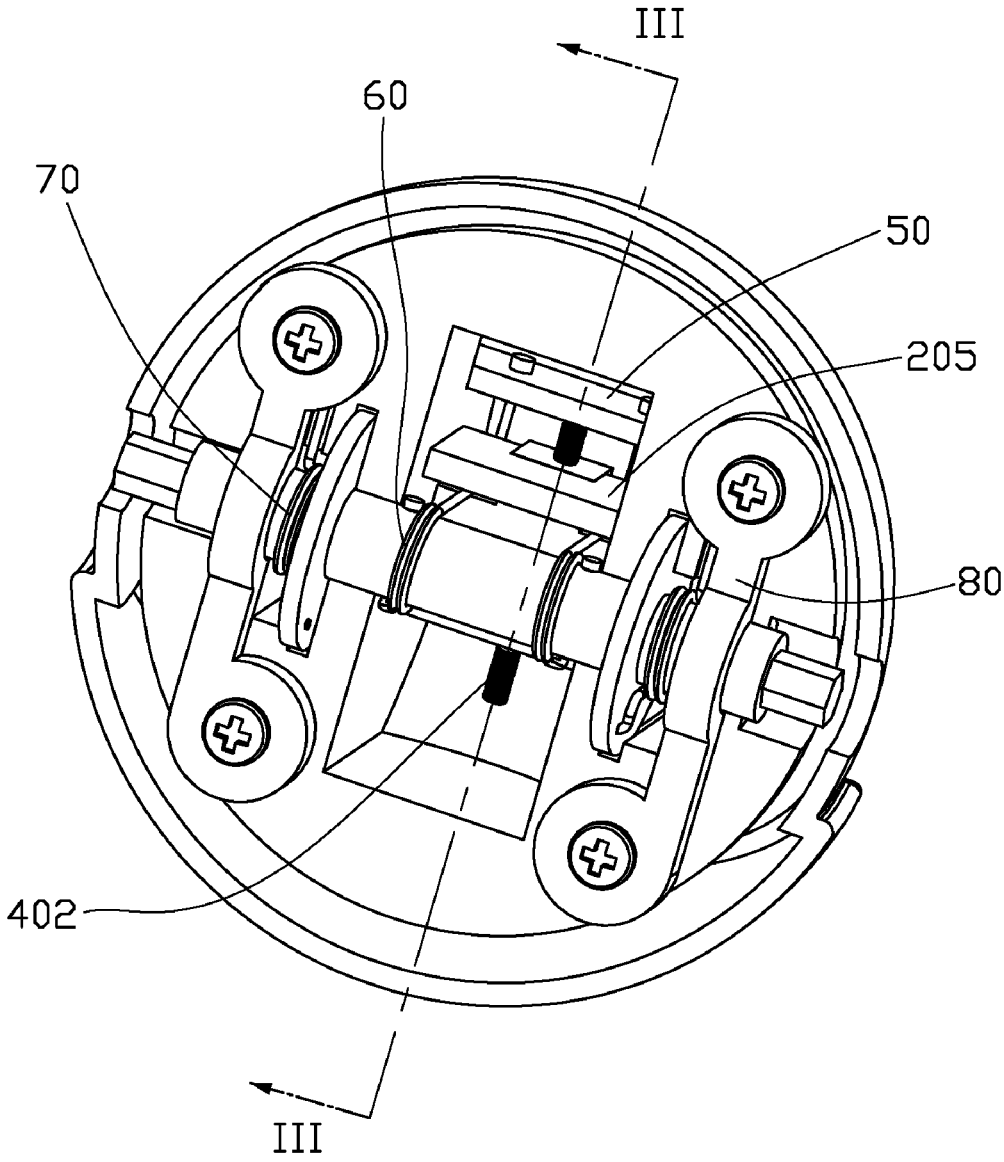
FIG. 4 is a partial inner view of the simulated eye of FIG. 1.
Figure 5:
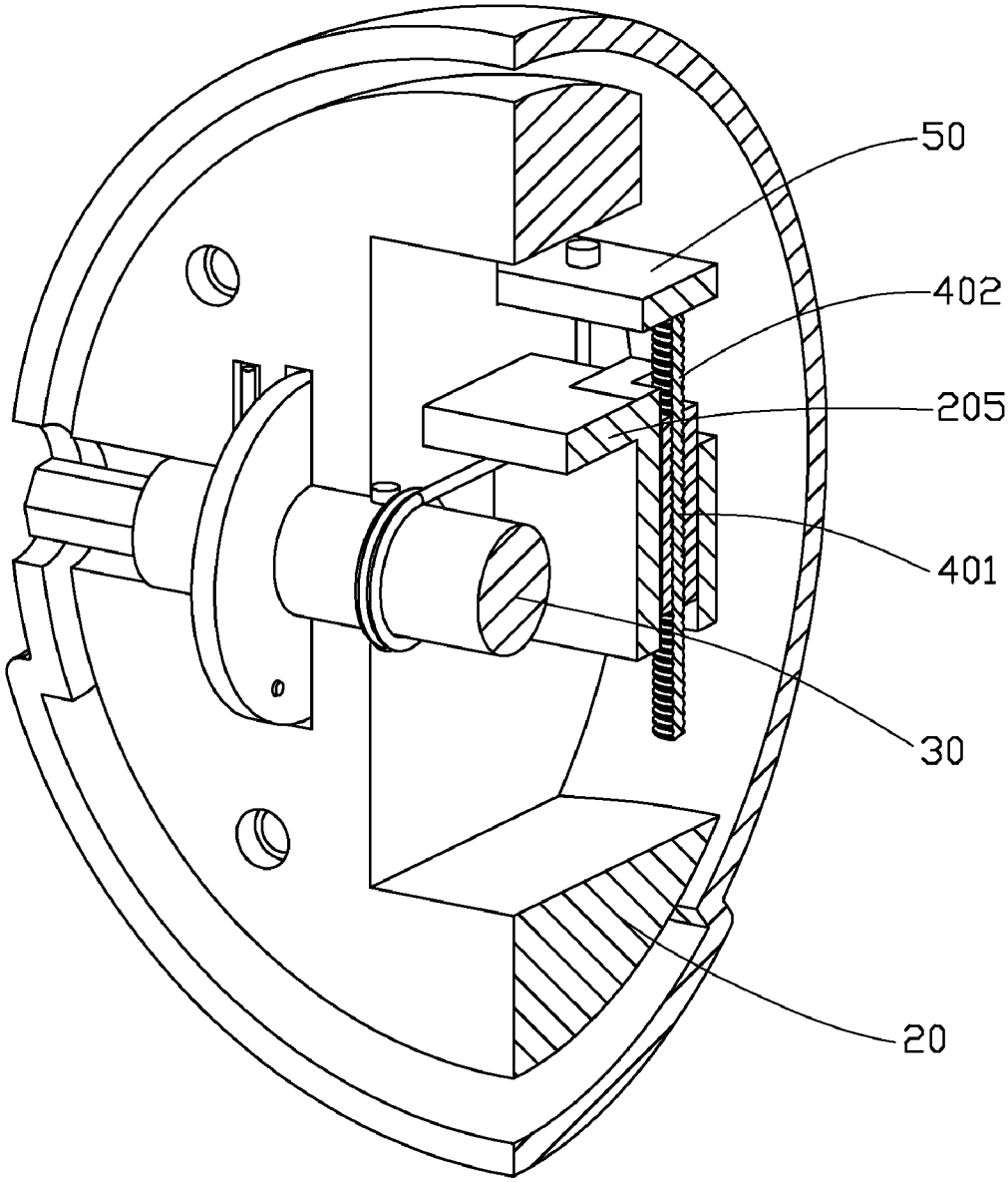
FIG. 5 is a cross-sectional view taken along line III-III of FIG. 4.

Referring also to FIGS. 4-5, a stopper sheet 205 is mounted on the receiving space 204. The stopper sheet 205 defines a third through hole 208. The third through hole 208 is configured for receiving the motor shaft 402, such that the motor shaft 402 is slidably received in the third through hole 208. It should be noted that during assembly, the stopper sheet 205 is arranged between the main body 401 of the driving device 40 and the connecting sheet 50, thus, the stopper sheet 205 limits the range of the linear movement of the connecting sheet 50.

The simulated eye 100 further includes two elastic element 70, and two fixing members 80. The fixing members 80 are configured for limiting the pivot rod 30 in the elongated recess 203 in a manner such that the pivot rod 30 is rotatable relative to the shell 20 and the two stopping members 301 are rotatably received in the two limiting slots 207 correspondingly. In the embodiment, the elastic elements 70 are torsion springs. The elastic elements 70 include a first arm 701, a second arm 702, and a main portion 703. The main portion 703 connects the first arm 701 with the second arm 702. The main portion 703 defines a shaft hole 704 for receiving the pivot rod 30. The first arm 701 is fixed to a stopping member 301, and the second arm 702 is fastened to the inner surface 201 of the shell 20. Therefore, the elastic elements 70 deform elastically when the pivot rod 30 is driven by the driving device 40 to rotate in a first direction, and the elastic elements 70 return to normal to drive the pivot rod 30 to rotate in a second direction opposite to the first direction when the pivot rod 30 is not driven by the driving device 40.

When the driving device 40 moves the connecting sheet 50 upwardly, the transmission members 60 are pulled upwards, thus, the pivot rod 30 is driven to rotate clockwise. As a result, the elastic elements 70 deform elastically, the upper eyelid 10 rotates away from the lower eyelid 11, and the simulated eye 10 is in an opened state as shown in FIG. 2. When the driving device 40 moves the connecting sheet 50 downwards, the transmission members 60 are released, and the elastic element 70 rebounds to drive the pivot rod 30 to rotate anticlockwise. As a result, the upper eyelid 10 is rotated toward the lower eyelid 11, and the simulated eye 10 changes to a closed state as shown in FIG. 1.

Therefore, by operationally controlling the driving device 40, the simulated eye 100 is changeable between the opened state and the closed state.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

an eyeball;

an upper eyelid covering the eyeball;

a pivot rod;

at least one transmission member, a part of each one of the at least one transmission member coiling around the pivot rod; and a driving device;

wherein the pivot rod is pivotally coupled to the eyeball, the upper eyelid is fixed to the pivot rod, the at least one transmission member connects the pivot rod with the driving device in a manner that the at least one transmission member drives the pivot rod in association with the upper eyelid to rotate when the driving device pulls the at least one transmission member, whereby the simulated eye is changed between a closed state and an opened state, and wherein the at least one transmission member is made of soft material, and the at least one transmission member connects the driving device with the pivot rod in a manner that opposite ends of the at least one transmission member are fastened to the driving device and the pivot rod correspondingly.

2. The simulated eye of claim 1, further comprising a shell, and the shell engaging with the eyeball.

3. The simulated eye of claim 2, wherein the shell defines a receiving space, and the driving device is received in the receiving space.

4. The simulated eye of claim 1, wherein the driving device comprises a motor shaft, and the motor shaft is driven by the driving device to move linearly.

5. The simulated eye of claim 4, wherein the driving device further comprises a connecting sheet, the connecting sheet is fixed to the motor shaft, and the at least one transmission member is fastened to the connecting sheet.

6. A simulated eye capable of being operated to change between an opened state and a closed state, the simulated eye comprising:

an eyeball portion disposed with an iris;

an eyelid coverable on the eyeball;

a pivot rod fixed to the eyelid;

at least one elastic element, wherein two ends of the at least one elastic element are fixed to the eyeball portion and the pivot rod correspondingly;

at least one transmission member coiling around the pivot rod; and a driving device coupled to the at least one transmission member and configured for pulling the at least one transmission member so as to rotate the pivot rod;

wherein when the driving device rotates the pivot rod via the at least one transmission member, the at least one elastic element deforms elastically, the eyelid is driven to rotate relative to the eyeball to the closed state, the iris of the eyeball is substantially hidden by the eyelid, and when the driving device stops rotating the pivot rod via the at least one transmission member, the at least one elastic element rebounds to rotate the pivot rod, and the eyelid is driven to rotate relative to the eyeball to the opened state, the iris of the eyeball is exposed and viewable.

7. The simulated eye of claim 6, wherein the driving device comprises a motor shaft, and the motor shaft is driven by the driving device to move linearly.

8. The simulated eye of claim 7, wherein one end of the at least one transmission member is fixed to the motor shaft.

9. The simulated eye of claim 6, wherein the driving device is a step motor or a servo motor.

10. A simulated eye, comprising:

an eyeball;

an upper eyelid covering the eyeball;

a pivot rod;

at least one transmission member, a part of each one of the at least one transmission member coiling around the pivot rod; and a driving device;

wherein the pivot rod is pivotally coupled to the eyeball, the upper eyelid is fixed to the pivot rod, the at least one transmission member connects the pivot rod with the driving device in a manner that the at least one transmission member drives the pivot rod in association with the upper eyelid to rotate when the driving device pulls the at least one transmission member, whereby the simulated eye is changed between a closed state and an opened state, the simulated eye further comprises at least one elastic element, and two ends of the at least one elastic element are fixed to the eyeball and the pivot rod correspondingly, wherein when the driving device rotates the pivot rod via the at least one transmission member, the at least one elastic element deforms elastically, the upper eyelid is driven to rotate relative to the eyeball to the closed state, and when the driving device stops rotating the pivot rod via the at least one transmission member, the at least one elastic element rebounds to rotate the pivot rod, and the eyelid is driven to rotate relative to the eyeball to the opened state.

* * * * *